US006095155A

United States Patent [19]

Criscuolo

[11] Patent Number: 6,095,155

[45] Date of Patent: Aug. 1, 2000

[54] RETAINING APPARATUS

[76] Inventor: Joseph Michael Paul Criscuolo, 32 Clerks Croft, Bletchingley, Surrey, RH1 42H, United Kingdom

[21] Appl. No.: 09/080,317

[22] Filed: May 15, 1998

[30] Foreign Application Priority Data

May 16, 1997 [GB] United Kingdom ..... 9709855

[51] Int. Cl.[7] ..... A45D 8/22

[52] U.S. Cl. ..... 132/278; 24/556; 24/563; D28/39

[58] Field of Search ..... 132/278, 275, 132/276, 273, 277, 279; 24/457, 458, 461, 543, 562, 563, 556; D28/39, 40

[56] References Cited

U.S. PATENT DOCUMENTS

| | | | |
|---|---|---|---|
| 1,316,981 | 9/1919 | Singer | 132/278 |
| 1,443,443 | 1/1923 | Tanner | 132/278 |
| 2,031,685 | 2/1936 | Bomber | 132/278 |
| 2,106,561 | 1/1938 | Beiter | 132/278 |
| 2,368,913 | 2/1945 | Bolinger | 132/278 |
| 2,403,601 | 7/1946 | Jackson | 132/278 |
| 5,762,076 | 6/1998 | Chan et al. | 132/278 |

*Primary Examiner*—Gene Mancene
*Assistant Examiner*—Pedro Philogene
*Attorney, Agent, or Firm*—Edwin D. Schindler

[57] ABSTRACT

First and second retaining elements extend from a hinge to lie adjacent one another, one of the retaining elements being formed to be reorientatable between first and second bowed positions of stability. A detent is spaced from the hinge and arranged hold captive respective portions of the first and second retaining elements. The apparatus is suitable for use particularly as a hair clip, clasp, or slide, but can be used for securing other material or items.

13 Claims, 5 Drawing Sheets

RETAINING APPARATUS

FIELD OF THE INVENTION

The present invention relates to retaining apparatus and in particular clips or clasps, especially hair clips, clasps or slides.

BACKGROUND OF THE INVENTION

Clips, clasps and slides for retaining locks of hair for example in position are well known.

Present devices include one or more of the following disadvantages, i.e. made of several components which can fail in use, unexpectedly catch material such as the hair or causing annoyance, or require complex finger movements.

Some use an action which limits the amount of material which can be held.

The present invention is directed to reduce or overcome these disadvantages by retaining a relatively small or large amount of material in a single device, being simple in construction, easy to use without complex finger movements with reduced risk of unwanted entanglement of material such as hair.

SUMMARY OF THE INVENTION

According to the invention, there is provided retaining apparatus comprising:

i) first and second retaining elements extending adjacent one another, one of the retaining elements being formed to be reorientatable between first and second bowed positions of stability;

ii) a hinge connecting the first and second retaining elements at a hinge zone; and, iii) detent means spaced from the hinge zone and arranged hold captive respective portions of the first and second retaining elements.

It is preferred that the detent means is arranged to hold the respective portions captive with the bowed retaining element orientated in both the first and second positions of stability.

Desirably, at least the first and second retaining elements and the hinge are formed from a unitary strip or sheet of material, preferably being bent or folded at the hinge zone to form the hinge and cause the first and second retaining elements to extend adjacent to one another.

Preferably, the hinge comprises a spring hinge arranged to normally bias the first and second retaining elements away from one another.

It is preferred that, with the bowed retaining element orientated in its first bowed position of stability, the bowed retaining element is movable from a release position biased away from the other retaining element by the hinge to an intermediate position held captive relative to the other retaining element by the detent means whilst remaining configured in the first bowed position of stability, the bowed retaining element subsequently being movable to its second position of bowed stability remaining held captive relative to the other retaining element by the detent means.

Desirably, in its first bowed configuration the bowed element has a substantially concave profile facing toward the other retaining element, in its second bowed configuration the bowed element having a substantially concave profile facing away from the other retaining element, preferably such that when held captive by the detent means with the bowed element in its first bowed configuration a maximum gap is defined between the retaining elements, and when subsequently moved to the second bowed configuration a minimum gap is defined between the retaining elements.

The detent means advantagously comprises a detent formation carried by one of the retaining elements and is arranged to capture and retain an edge of the other retaining element, the captured and retained edge preferably being remote from the hinge zone.

The detent formation preferably comprising a folded, rolled or bent over portion of the relevant retaining element.

The bowed retaining element beneficially comprises a pair of coextesive limbs spaced at respective proximal ends and joined at respecive distal ends (preferably in the region of the hinge zone) thereby inducing stresses warping the retaining element to be bowed.

The non-bowed retaining element preferably remains in substantially the same configuration when the retaining elements are held captive relative to one another by the detent means and when the detent means is released. The non-bowed retaining element preferably comprises a substantially solid sheet or strip of material.

The invention will now be further described in specific embodiments by way of example only and with reference to the accompanying drawings.

DESCRIPTION OF THE PREFERRED EMBODIMENTS

Figure 1A:
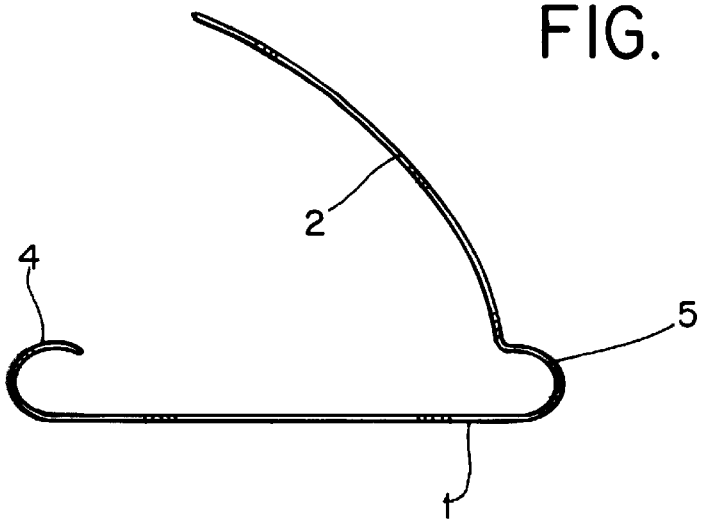
FIGS. 1*a* to 1*c* are schematic side views of exemplary retaining apparatus according to the invention in sequential configuration.

Referring to the drawings and initially to FIGS. 1*a* to 1*c* and 3*a* to 3*c*, there is shown a hair retaining clip comprising a elongate retaining arm 2 connected to a backing limb 1 via an interconnecting spring hinge 5.

Figure 2A:
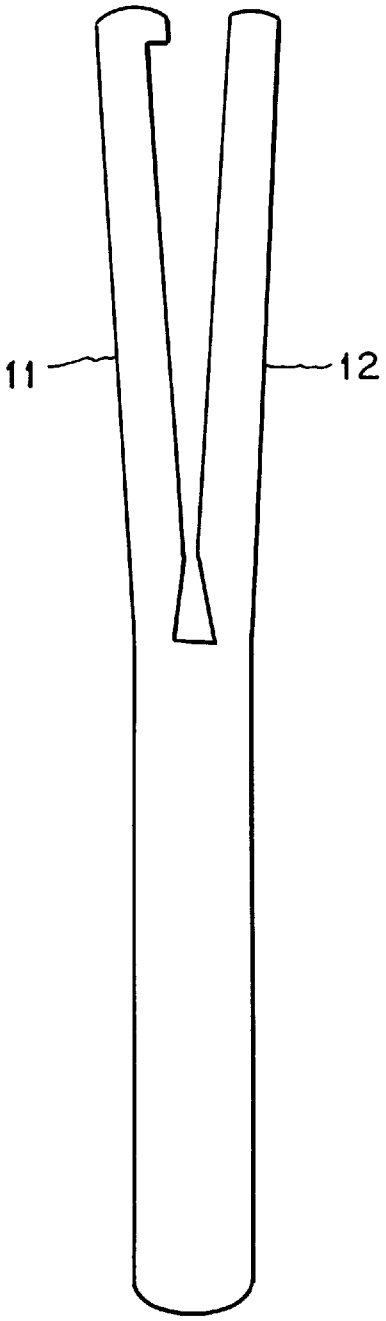
FIGS. 2*a* and 2*b* and plan views of an embodiment of the retaining apparatus in sequential stages of manufacture.
Figure 2B:
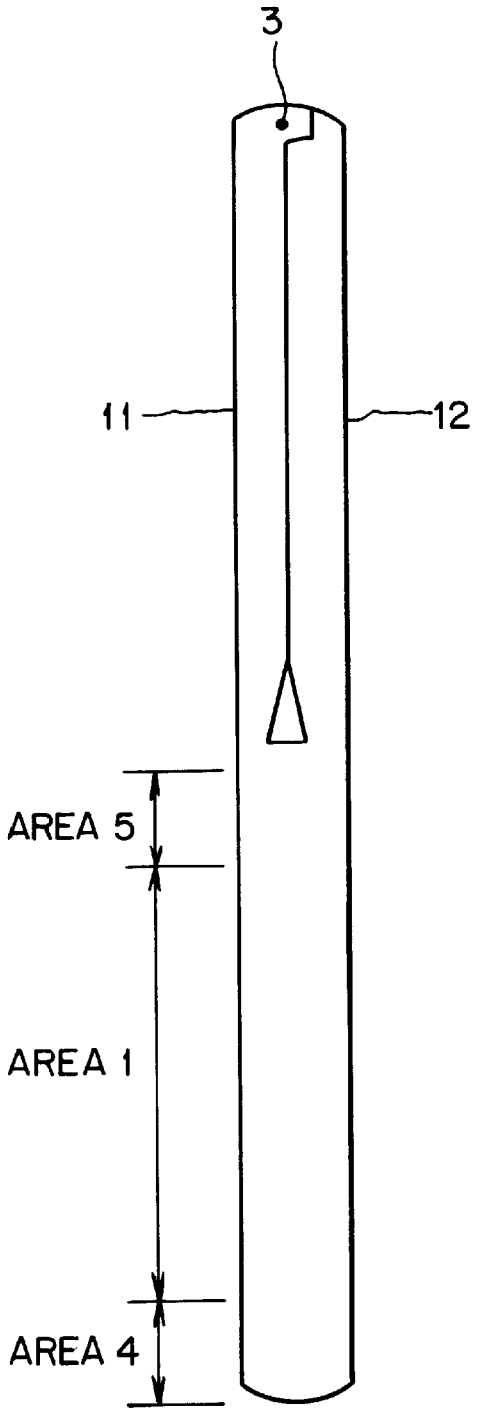

Backing 1 terminates in a roll over detent portion. The entire clip is formed from a unitary strip of metallic material (such as spring stainless steel or spring copper as shown most clearly in FIGS. 2*a* and 2*b*. The sheet is stamped or cut to define a pair of arms 11, 12 as shown in a relaxed (unstressed) "v" configuration in FIG. 2*a*. As shown in FIG. 2*b* arms 11, 12 are brought together at their distal ends and rivetted using a rivet 3, in so doing inducing stresses in the arm 2 to cause it to deform to a bowed configuration. The strip is then folded such that area 5 forms the spring hinge 5, area 1 forms the backing limb 1 and area 4 the terminal detent portion 4.

Figure 3A:
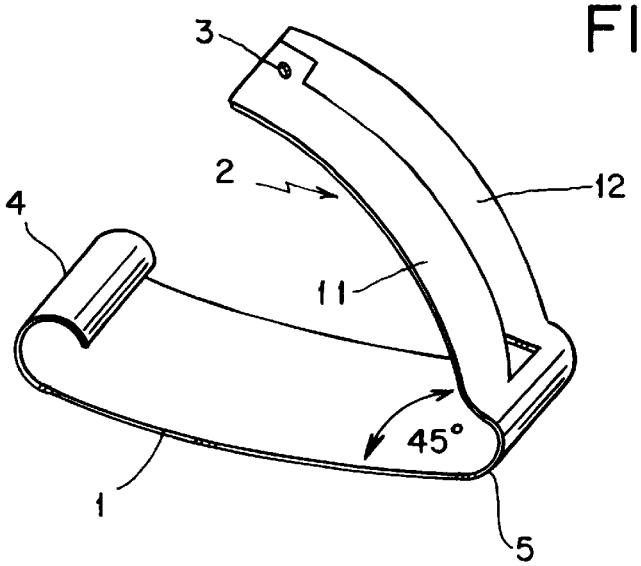
FIGS. 3*a* to 3*c* are perspective view (corresponding to the views shown in FIGS. 1*a* to 1*c*) of the apparatus of FIG. 2.
Figure 3B:
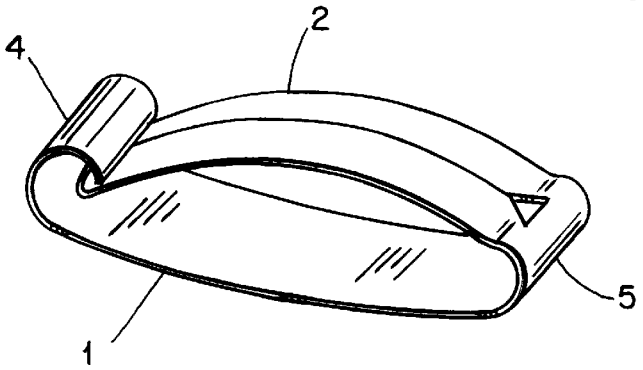

As shown in FIGS. 1*a* to 1*c* and 3*a* to 3*c*, in use the spring hinge is arranged to normally bias retaining arm 2 to the position shown in FIGS. 1*a* and 3*a* such that the distal end of bowed arm 2 is spaced from terminal detent portion 4. In order to retain material (such as hair) between bowed arm 2 and backing limb 1, arm 2 is manually pivoted about hinge 5 such that the distal end 2 springs past detent 4 and is retained in the position shown in FIGS. 1*b* and 3*b*. In this position, the distal end of retaining arm 2 is biased against the detent portion 4; the biasing force is however insufficient to cause the arm to spring out of engagement with detent portion 4. Subsequently arm 2 is pressed in its centre downwardly by the user in a direction toward the backing limb 1 such that arm 2 springs to the position shown in FIGS. 1*c* and 3*c* in which arm 2 flips to a second position of bowed stability closely adjacent backing limb 1 and in which the distal end of arm 2 remains engaged with detent portion 4.

Figure 1B:
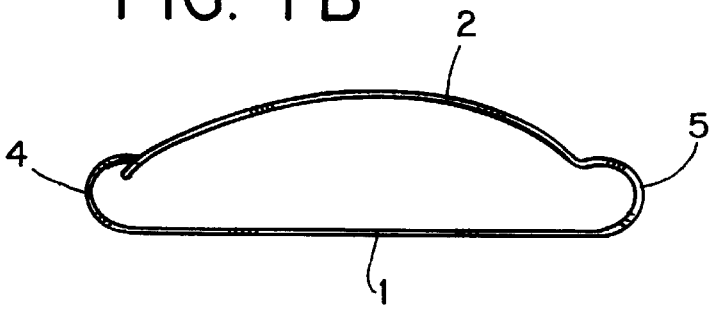
Figure 1C:
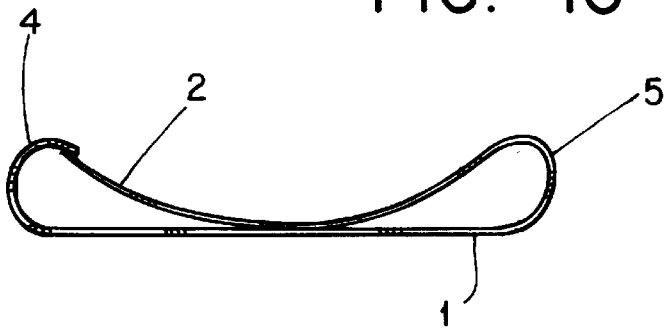
Figure 3C:
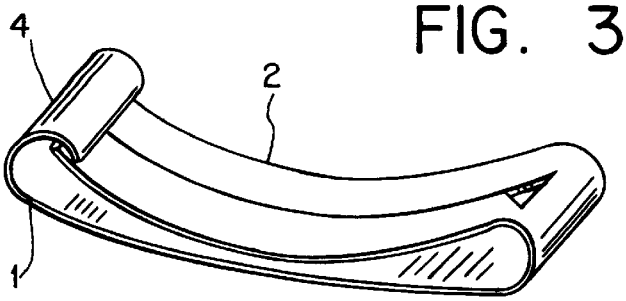

Because the retaining arm 2 is formed in the manner described above, two positions of bowed stability exist, the first being shown in FIGS. 1*a*, 1*b* (and 3*a*, 3*b*) and the second as shown in FIGS. 1*a* and 3*c*. In the position shown in FIGS. 1*c* and 3*c*, material is securely clipped between retaining arm 2 and backing limb 1.

The material is released (and the clip opened) by pressing the centre of backing limb 1 towards retaining arm 2, countered by a pressure on detent portion 4 and spring hinge 5. Flexing backing limb 1 causes the distance between detent portion 4 and spring hinge 5 to increase allowing the distal end of retaining arm 2 to escape from detent portion 4. Subsequently retaining arm 2 returns to the position shown in FIGS. 1*a* and 3*a* thereby releasing the material.

Figure 4A:
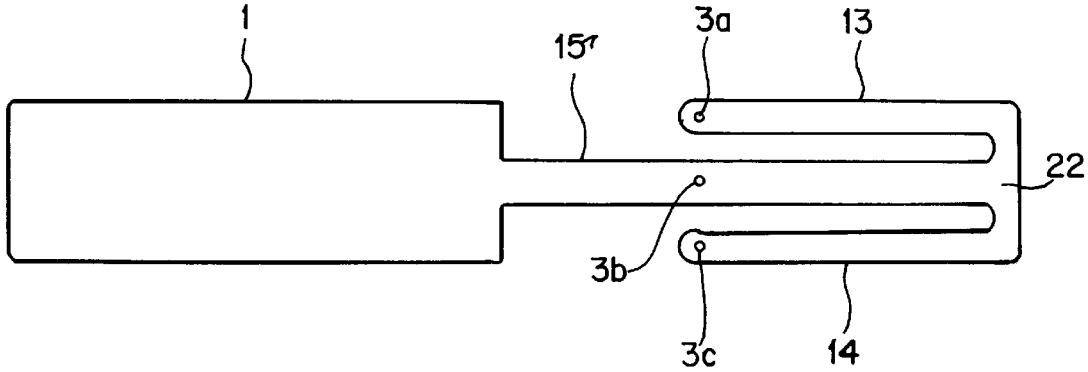
FIG. 4*a* is a plan view of an alternative embodiment of apparatus according to the invention in a first stage of manufacture.
Figure 4B:
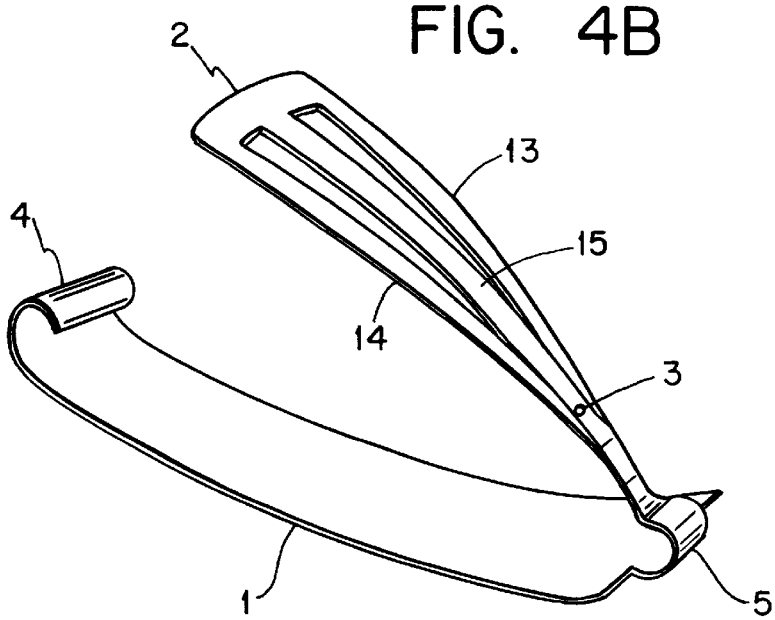
FIG. 4*b* is a perspective view of the apparatus of FIG. 4 when formed into its operational shape.

A second embodiment of retaining apparatus is shown in FIGS. 4*a* and 4*b*.

In this embodiment retaining arm 2 is formed from a stamped profile (shown in FIG. 4*a*) in which retaining arm 2 is formed from a central spine 15, having a pair of arms spaced one either side thereof extending from a joining portion 22. The distal end of arms 13, 14, and a portion of the central spine 15, are provided with respective apertures 3*a*, 3*b*, 3*c*, arranged to overlap and provide connection by rivet 3 (to stress and bow the arm 2). In this embodiment the rivet connection is therefore in the region of the spring hinge 5.

The width of spring hinge 5 is selected to give the preferred spring strength.

The operation of the device is the same as described in relation to the embodiments of FIGS. 1*a* to 1*c* and 3*a* to 3*c*.

The embodiment of FIG. 4 is generally similar to those previously described but further includes a nib 17, extending downwardly from the rolled over portion 16. The detent 16 and nib 17 provide the detent for receiving the distal end of arm 2. The curved profile 16 facilitates the smooth passage of the distal end of arm 2; nib 17 prevents the distal end of bowed arm 2 from becoming trapped between the rolled over portion 16 and backing limb 1.

Figure 4C:
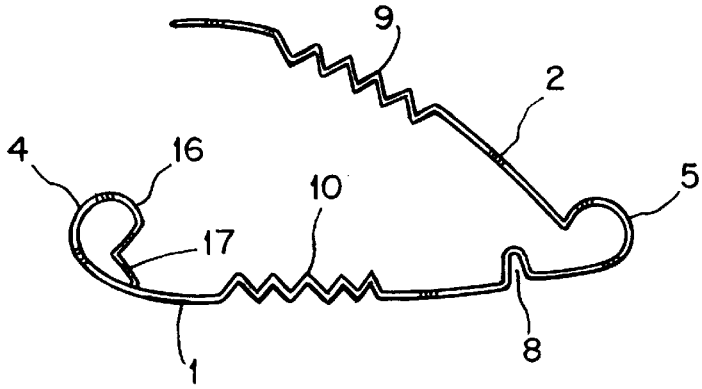
FIG. 4*c* is a schematic side view of an alternative embodiment of apparatus according to the invention.

In the embodiment shown in FIG. 4*c*, arm 2 and backing limb 1 are provided with respective corrugated formations 9, 10 to assist in gripping the material therebetween. Furthermore, a projection 8 is formed extending upwardly from backing limb 1 to act as a spacer showing a predetermined gap between backing limb 1 and arm 2 when the clip is closed on thick material.

As an alternative to the formation of corrugations 9, 10 integrally with the clip, a pad having a relatively high coefficient of friction or serrations may be attached to the inner surface of backing limb 1 and retaining arm 2 to assist in holding the gripped material.

Figure 5A:
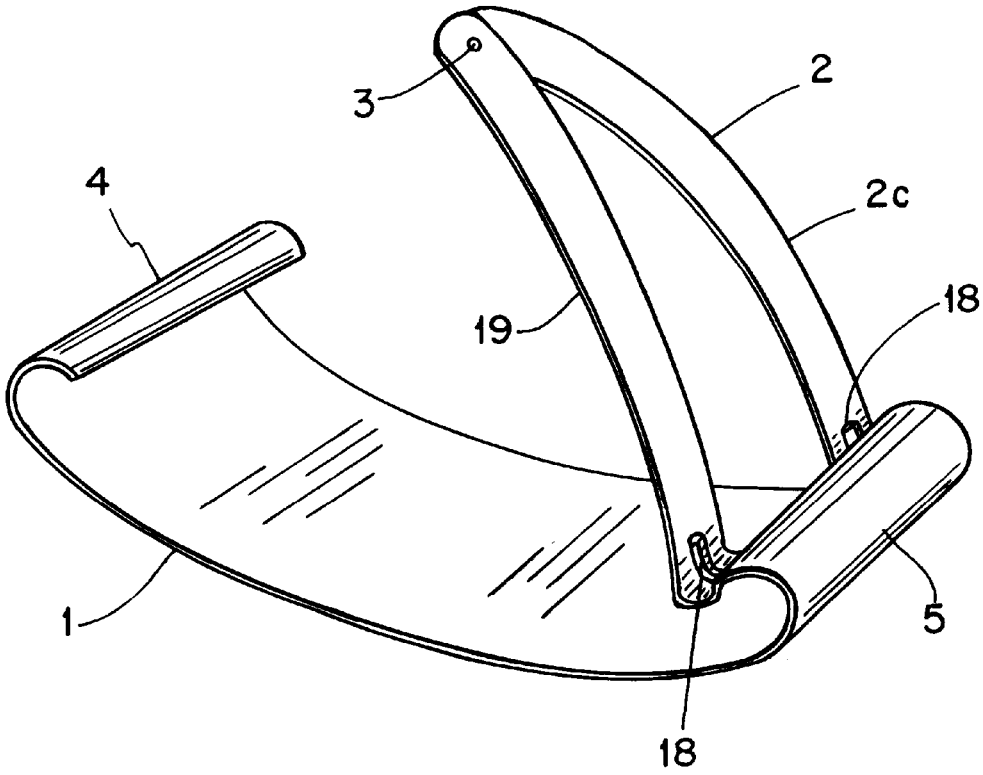
FIGS. 5*a* and 5*b* show a still further embodiment of apparatus according to the invention in alternative configurations.
Figure 5B:
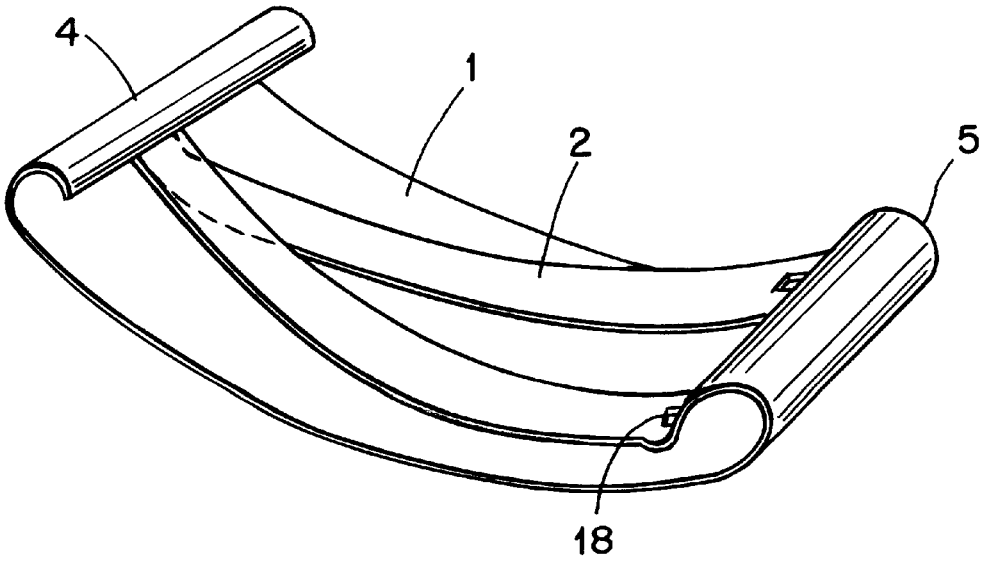

The further embodiment shown in FIGS. 5*a* and 5*b* operates in a generally similar manner to those previously described. In this embodiment, the bowed arm 2 is formed of a pair of spaced arms extending from the hinge 5 and brought together to be joined by rivet 3 in bowed configuration at their respective distal ends. Slots 18 are cut into the junctions between the proximal ends of limbs 19, 20 and hinge 5 to provide a weakened spring effect (if desired). FIG. 5*a* shows the arrangement in a configuration with the bowed arm 2 in its first position of bowed stability; FIG. 5*b* shows the arrangement in the gripping configuration with bowed arm 2 pressed home to its second position of bowed stability.

The clip may readily be adapted to act as a hair retaining device, a device for holding lapel badges in position, closures for wearing apparel, stationery and the like, hand held or mounted in a suitable frame for holding parts to be manipulated or worked upon.

Decoration may be added to the clip (particularly to the backing limb 1 which in use presents its rear face outwardly from the head of the wearer) either by engraving, painting, lacquering, attaching decorative or valuable objects and the like.

As a hair slide, the present invention includes the following advantages over current devices.

1. The hair slide lies almost flat against the head and is thus more comfortable for the wearer at rest.

2. Being in one piece as to functional parts, it is easier to manufacture and put in position than so-called automatic clips.

3. The simplicity of profile lowers the chance of hair entanglement.

4. Capable of operation by one hand.

5. Will hold all types of hair equally well, thick or thin locks or dense and heavy hair.

6. The risk of slipping after application is reduced.

7. Easy to release.

I claim:

1. Retaining apparatus comprising:

i) first and second retaining elements extending adjacent one another, one of the retaining elements being formed to be reorientatable between first and second bowed positions of stability;

ii) a hinge connecting the first and second retaining elements at a hinge zone; and, iii) detent means spaced from the hinge zone and arranged hold captive respective portions of the first and second retaining elements.

2. Retaining apparatus according to claim 1, wherein the detent means is arranged to hold the respective portions captive with the bowed retaining element orientated in the first and second positions of stability.

3. Retaining apparatus according to claim 1, wherein at least the first and second retaining elements and the hinge are formed from a unitary strip or sheet of material.

4. Retaining apparatus according to claim 3, wherein the strip or sheet material is bent or folded at the hinge zone to form the hinge and cause the first and second retaining elements to extend adjacent to one another.

5. Retaining apparatus according to claim 1, wherein the hinge comprises a spring hinge arranged to normally bias the first and second retaining elements away from one another.

6. Retaining apparatus according to claim 1, wherein, with the bowed retaining element orientated in its first bowed position of stability, the bowed retaining element is movable from a release position biased away from the other retaining element by the hinge to an intermediate position held captive relative to the other retaining element by the detent means whilst remaining configured in the first bowed position of stability, the bowed retaining element subsequently being movable to its second position of bowed stability remaining held captive relative to the other retaining element by the detent means.

7. Retaining apparatus according to claim 1, wherein in its first bowed configuration the bowed element has a substantially concave profile facing toward the other retaining element, in its second bowed configuration the bowed element having a substantially concave profile facing away from the other retaining element, preferably such that when held captive by the detent means with the bowed element in its first bowed configuration a maximum gap is defined between the retaining elements, and when subsequently moved to the second bowed configuration a minimum gap is defined between the retaining elements.

8. Retaining apparatus according to claim 1, wherein the detent means comprises a detent formation carried by one of the retaining elements arranged to capture and retain an edge of the other retaining element, which edge is remote from the hinge zone.

9. Retaining apparatus according to claim 8, wherein the detent formation comprises a folded, rolled or bent over portion of the relevant retaining element.

10. Retaining apparatus according to claim 1, wherein the bowed retaining element comprises a pair of coextesive limbs spaced at respective proximal ends and joined at respecive distal ends thereby inducing stresses warping the retaining element to be bowed.

11. Retaining apparatus according to claim 10, wherein the bowed retaining element comprises a pair of coextesive limbs spaced at respective proximal ends and joined at respecive distal ends in the region of the hinge zone.

12. Retaining apparatus according to claim 1, wherein the non-bowed retaining element remains in substantially the same configuration when the retaining elements are held captive relative to one another by the detent means and when the detent means is released.

13. Retaining apparatus according to claim 1, wherein the non-bowed retaining element comprises a substantially solid sheet or strip of material.

* * * * *